US011164503B2

(12) United States Patent
Zhang et al.

(10) Patent No.: US 11,164,503 B2
(45) Date of Patent: Nov. 2, 2021

(54) DISPLAY PANEL, CONTROL METHOD AND APPARATUS THEREOF, AND CONTROL DEVICE

(71) Applicant: HKC CORPORATION LIMITED, Shenzhen (CN)

(72) Inventors: Liang Zhang, Shenzhen (CN); Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/329,488

(22) Filed: May 25, 2021

(65) Prior Publication Data

US 2021/0280120 A1 Sep. 9, 2021

Related U.S. Application Data

(63) Continuation of application No. PCT/CN2019/124868, filed on Dec. 12, 2019.

(30) Foreign Application Priority Data

Dec. 28, 2018 (CN) ..... 201811632288.9

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01)

(58) Field of Classification Search
None
See application file for complete search history.

(56) References Cited

U.S. PATENT DOCUMENTS

2004/0212632 A1 10/2004 Inada et al.
2010/0156954 A1 6/2010 Kim et al.
2012/0113154 A1* 5/2012 Ge ..... G09G 3/3614 345/690
2013/0241901 A1* 9/2013 Bae ..... G06F 1/3265 345/204

(Continued)

FOREIGN PATENT DOCUMENTS

CN 101320152 A 12/2008
CN 103280204 A 9/2013

(Continued)

OTHER PUBLICATIONS

First Office Action issued in counterpart Chinese Patent Application No. 201811632288.9, dated Jan. 3, 2020.

(Continued)

*Primary Examiner* — Parul H Gupta
(74) *Attorney, Agent, or Firm* — Westbridge IP LLC

(57) ABSTRACT

The disclosure discloses a display panel and a display array of the display panel. The pixel group comprises a first pixel column, a green pixel column and a second pixel column, the green pixel column includes a plurality of green sub-pixels, the data lines connected with the driver include a first branch and a second branch connected in series with the first branch, the first branch is provided with a first switch, and the second branch is provided with a second switch and a step-down unit. The disclosure further discloses a display panel control method and a display panel control device.

19 Claims, 6 Drawing Sheets

(56) References Cited

U.S. PATENT DOCUMENTS

| | | | | |
|---|---|---|---|---|
| 2015/0077412 | A1 | 3/2015 | Nakamura | |
| 2015/0161927 | A1* | 6/2015 | Hekstra | G09G 3/3614 345/209 |
| 2017/0236487 | A1* | 8/2017 | Guo | G09G 3/2074 345/211 |
| 2018/0075818 | A1 | 3/2018 | Kim et al. | |

FOREIGN PATENT DOCUMENTS

| | | | |
|---|---|---|---|
| CN | 103744208 | A | 4/2014 |
| CN | 103839526 | A | 6/2014 |
| CN | 204204378 | U | 3/2015 |
| CN | 104834138 | A | 8/2015 |
| CN | 106023918 | A | 10/2016 |
| CN | 107886924 | A | 4/2018 |
| CN | 108922467 | A | 11/2018 |
| CN | 109785808 | A | 5/2019 |
| JP | 2003228337 | A | 8/2003 |
| JP | 2017067798 | A | 4/2017 |
| KR | 20070109164 | A | 11/2007 |
| KR | 20130022623 | A | 3/2013 |

OTHER PUBLICATIONS

International Search Report and Written Opinion issued in corresponding PCT Application No. PCT/CN2019/124868, dated Mar. 12, 2020.

* cited by examiner

DISPLAY PANEL, CONTROL METHOD AND APPARATUS THEREOF, AND CONTROL DEVICE

CROSS-REFERENCE TO RELATED APPLICATIONS

The present disclosure is a continuation application of International Application No. PCT/CN2019/124868, filed on Dec. 12, 2019, entitled "DISPLAY PANEL, CONTROL METHOD AND APPARATUS THEREOF, AND CONTROL DEVICE" which claims the priority of Chinese application with application No. 201811632288.9, filed on Dec. 28, 2018, entitled "DISPLAY PANEL, CONTROL METHOD AND APPARATUS THEREOF, AND CONTROL DEVICE". The disclosures of the aforementioned applications are hereby incorporated by reference in their entireties.

FIELD

The disclosure relates to the technical field of display, in particular to a display panel, a display panel control method, and a display panel control apparatus.

BACKGROUND

The statements here only provide background information related to the present application, and do not necessarily constitute prior art.

At present, in order to improve the display effect of the display panel, most display panels are driven with the voltages of opposite polarities to drive the pixel points to emit. However, the pixel electrode voltages of different polarities can pull the common electrode voltage at the same time. When the red, green and blue three-seed pixels are driven by different polarities, the polarity coupling of the green sub-pixels to the common electrode cannot counteract the polarity coupling of the red and blue sub-pixels to the common electrode, so that the voltage difference between the pixel electrode and the common electrode of the green sub-pixel becomes larger. In particular, in the display screen driven by the column inversion, the sub-pixels of adjacent columns are driven by different polarities, the sensitivity of human eyes to green is greater than to red and blue, and the green sub-pixels of each column are lightened, so that the whole picture of the screen seen by the user is green.

SUMMARY

The main purpose of the disclosure is to provide a display panel, which aims to avoid the phenomenon of green color when the picture is displayed, and improve the display effect of the display screen.

In order to achieve the above object, the present disclosure provides a display panel, the display panel including:

a display array, including a plurality of pixel groups, the pixel group including a first pixel column, a green pixel column and a second pixel column sequentially, the green pixel column including a plurality of green sub-pixels, the first pixel column including a plurality of first sub-pixels, the second pixel column including a plurality of second sub-pixels;

a driver connected to each of the green sub-pixels, each of the first sub-pixels, each of the second sub-pixels through a data line, the data line connecting each of the green sub-pixels to the driver including a first branch and a second branch connected in series with the first branch, the first branch being configured with a first switch, the second branch being configured with a second switch and a step-down unit that is connected in series with the second switch, the second switch being connected and the first switch being disconnected when a polarity of a drive voltage of the green pixel column is opposite to a polarity of a drive voltage of the first pixel column and a polarity of the drive voltage of the second pixel column.

According to the display panel provided by the embodiments of the disclosure, in the display panel of the first pixel column, the green pixel column and the second pixel column are sequentially arranged. Two branches are arranged in the data line connecting each of the green sub-pixels to the driver. One branch is provided with a switch and a step-down unit, and the other branch is provided with a switch. When the display panel is driven in a column inversion mode, the branch provided with the step-down unit is turned on, and the branch without the step-down unit is disconnected, so that the step-down unit and the green sub-pixel are connected in series, reducing the drive voltage obtained by the green sub-pixel through the voltage dividing effect of the step-down unit, the pixel voltage corresponding to the green pixel column is prevented from being too large due to the polarity coupling generated by the first pixel column and the second pixel column to a common electrode, and the display quality of the display screen is improved.

Figure 1:
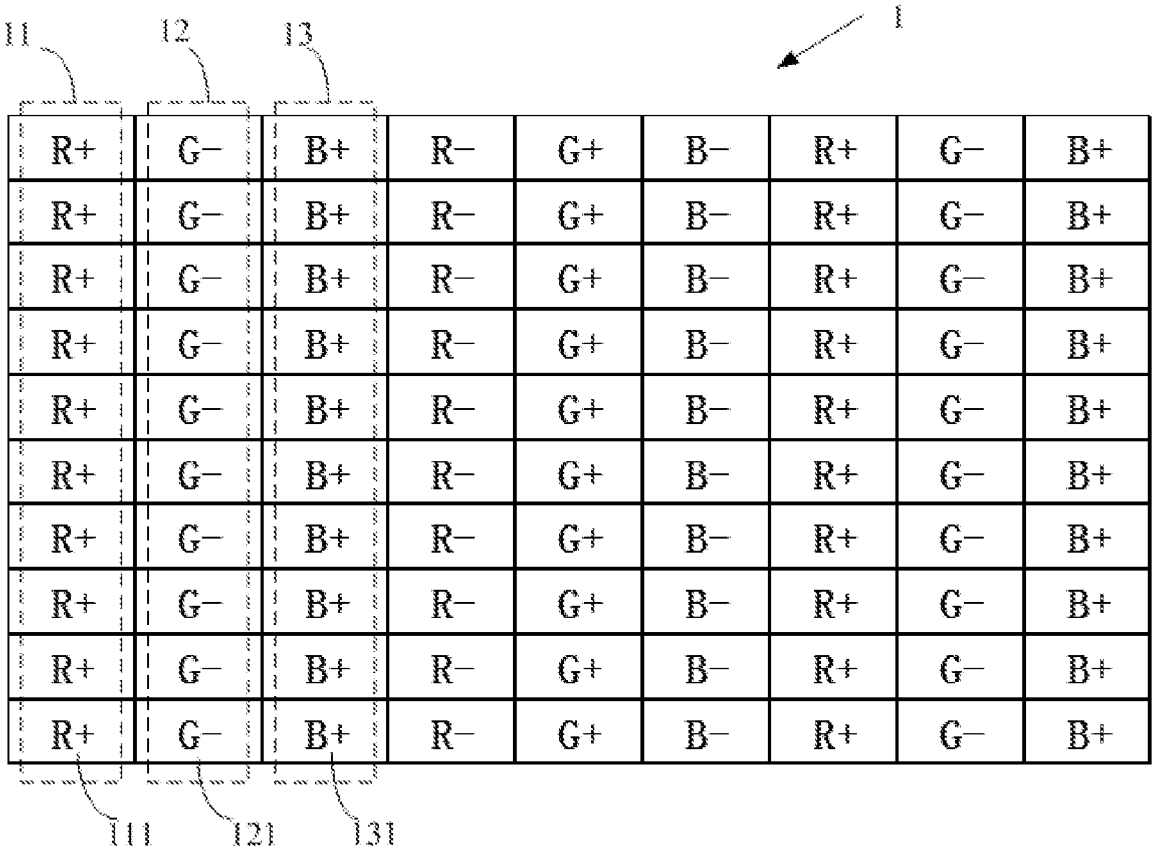
FIG. 1 is a schematic diagram of a display array arrangement structure in a display panel according to an embodiment of the present disclosure.

The purpose of the present disclosure is to be described further with reference to the accompanying drawings.

DETAILED DESCRIPTION OF THE EMBODIMENTS

It should be understood that the specific embodiments described herein are used merely to explain the present disclosure and are not intended to limit the present disclosure.

The main solution of the embodiments of the present disclosure is to provide a display panel, the display panel including:

a display array 1 and a driver 2, the display array 1 including a plurality of pixel groups, the pixel group including a first pixel column 11, a green pixel column 12 and a second pixel column 13 arranged sequentially. The green pixel column 12 includes a plurality of green pixels 121, the first pixel column 11 includes a plurality of first sub-pixels 111, and the second pixel column 13 includes a plurality of second sub-pixels 131. The driver 2 is connected with each of the green sub-pixels 121, each of the first sub-pixels 111, each of the second sub-pixels 131 though a data line. The data line connecting each of the green sub-pixels 121 and the driver 2 includes a first branch and a second branch connected with the first branch in parallel. The first branch is configured with a first switch 01, and the second branch is configured with a second switch 02 and a step-down unit 03 connected with the second switch 02 in series.

In a picture displayed by the display panel driven by the column inversion, the pixel columns of different colors are driven by different polarities. The pixel voltage of the green sub-pixels 121 is higher due to the polarity coupling effect between the drive voltage of each sub-pixel and the common voltage. The sensitivity of the human eye to the green color is greater than to the red color and the blue color, the green sub-pixels 121 of each column are bright, and the green range of the brightness is relatively concentrated, so that the overall green color of the screen seen by the user is caused.

Therefore, the present disclosure provides a display panel with the above structure, to avoid that a corresponding pixel voltage of the green pixel column 12 is too large due to a polarity coupling produced by the first pixel column 11 and the second pixel column 13, and avoid a displayed picture to become green, thereby improving the display effect of the display screen.

The present disclosure provides a display panel. Specifically, the display panel can include a liquid crystal display panel.

In embodiments of the present disclosure, the display panel includes a display array 1, a driver 2 and a display panel control apparatus 3. As shown in FIG. 1, the display array 1 includes a plurality of pixel groups, each pixel group includes a first pixel column 11, a green pixel column 12 and a second pixel column 13. The display panel control apparatus 3 is connected with the driver 2 to control the driver 2 to operate. In the display array 1, different pixel groups emit light in different colors and brightness driven by the driver 2 to display a current image frame.

The first pixel column 11 and the second pixel column 13 are pixel columns with colors different from a green color, in particular the first pixel column 11 can be a red pixel column and the second pixel column 13 can be a blue pixel column. The first pixel column 11, the green pixel column 12 and the second pixel column 13 are sequentially and repeatedly to form the display array 1. Except the first pixel column 11, the green pixel column 12 and the second pixel column 13, the pixel group may further include other color pixel columns. A plurality of pixel groups formed by arranging the pixel columns in different colors including the green pixel column 12 form the display array 1.

The driver 2 is respectively connected with the first pixel column 11, the second pixel column 13 and the green pixel column 12. A control chip of the display panel generates gray scale data corresponding to each pixel column according to the image data of a currently displayed image frame, and the gray scale data are sent to the driver 2. The driver 2 generates a drive voltage according to gray scale data of each pixel column and respectively drives the first pixel column 11, the second pixel column 13 and the green pixel column 12. A voltage difference (pixel voltage) of each of the pixel columns generated in between the received drive voltage and the common voltage drives a light emitting factor (such as the liquid crystal molecules) to deflect and light to realize an image display. In particular, when the first pixel column 11 is a red pixel column, the first pixel column 11 is driven by the driver 2 to emit red light; the green pixel column 12 is driven by the driver 2 to emit green light. When the second pixel column 13 is a blue pixel column, the second pixel column 13 is driven by the driver 2 to emit blue light. In particular, in FIG. 1, a + symbol indicates a positive polarity drive voltage, a − symbol indicates a negative polarity drive voltage. The driver 2 can drive each pixel array of the display array 1 by adopting the column inversion method, and adjacent pixel columns are driven by driven voltages with opposite polarities. For example, the driver 2 drives the first pixel column 11 and the second pixel column 13 of a pixel group by adopting a positive polarity drive voltage while the driver 2 drives the green pixel column 12 by adopting a negative voltage drive voltage. In another pixel group adjacent to this pixel group, the driver 2 drives the first pixel column 11 and the second pixel column 13 by adopting a negative polarity drive voltage, while the driver 2 drives the green pixel column 12 by adopting a positive polarity drive voltage.

Specifically, the green pixel column 12 includes a plurality of green sub-pixels 121, the first pixel column 11 includes a plurality of first sub-pixels 111, and the second pixel columns 13 include a plurality of second sub-pixels 131. The driver 2 is connected with each of the green sub-pixels 121, each of the first sub-pixels 111 and each of the second sub-pixels 131 through a data line.

Figure 2:
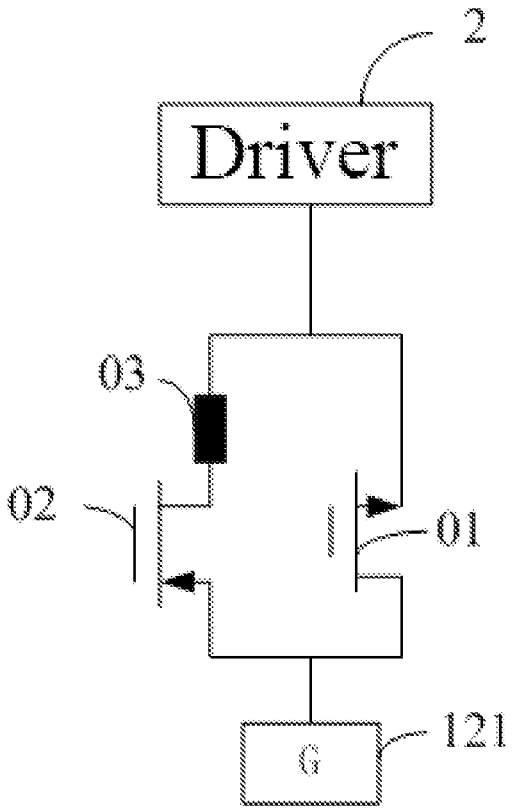
FIG. 2 is a schematic diagram of a connection structure between a driver and a green sub-pixel according to an embodiment of the present disclosure.

Each of the green sub-pixels 121, each of the first sub-pixels 111 and each of the second sub-pixels 131 include a thin-film transistor, and the driver 2 is respectively connected with a source of each of thin-film transistors through a data line. The drive voltage corresponding to each pixel column includes the sub-drive voltage value of each sub-pixel in the pixel column. The control chip of the display panel generates corresponding gray scale data of each sub-pixel according to the image data of the currently displayed image frame and sends the gray scale data to the driver 2, and the driver 2 generates a corresponding drive voltage according to the gray-scale data corresponding to each sub-pixel to drive each of the green sub-pixels 121, each of the first sub-pixels 111 and each of the second sub-pixels 131 respectively. In particular, as shown in FIG. 2, the data line connected between the driver 2 and each green sub-pixel 121 includes a first branch and a second branch connected in series with the first branch. The first branch is provided with a first switch 01, and the second branch is provided with a second switch 02 and a step-down unit 03 connected in series with the second switch 02. The step-down unit 03 can be specifically a variable resistor with adjustable resistance. The display panel control apparatus 3 can be respectively connected with the first switch 01, the second switch 02 and the step-down unit 03, and the display panel control apparatus 3 can control the connection or disconnection of the first switch 01 and the second switch 02 by sending an enable signal, and can adjust a resistance of a resistor connected in the circuit.

In particular, in order to simplify a peripheral switch signal generation circuit, the first switch 01 and the second switch 02 can be specifically a metal oxide semiconductor transistor (MOS transistor), specifically the first switch 01 can be a P-type MOS transistor, and the second switch 02 can be an N-type MOS transistor.

In the embodiment of the disclosure, the first pixel column 11, the green pixel column 12 and the second pixel column 13 are sequentially arranged in the display panel, and two branches are arranged in the data line connecting the driver 2 and each of the green sub-pixels 121. One branch is provided with a switch and a step-down unit 03, and the other branch is provided with a switch. When the display panel is driven in the column inversion mode, the branch which is provided with the step-down unit 03 is conducted, and the branch without the step-down unit 03 is cut off, so that the step-down unit 03 and the green sub-pixel 121 are connected in series, the drive voltage obtained by the green sub-pixel 121 is reduced through the partial voltage effect of the step-down unit 03, the pixel voltage corresponding to the green pixel column 12 is prevented from being too large due to the polarity coupling generated by the first pixel column 11 and the second pixel column 13, and the display effect of the display screen is improved.

Figure 3:
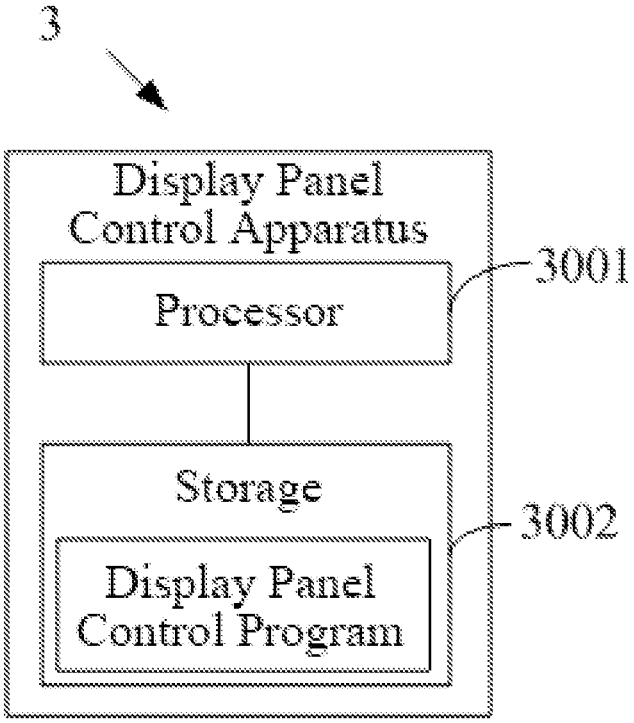
FIG. 3 is a hardware structure diagram of a display panel control apparatus according to an embodiment of the present disclosure.

In particular, as shown in FIG. 3, the display panel control apparatus 3 can include a processor 3001, such as a CPU, and a memory 3002. The processor 3001 is respectively connected with the memory 3002, the driver 2, the first switch 01, the second switch 02 and the step-down unit 03 to control the operation of those components. The memory 3002 may be a high-speed RAM memory or a non-volatile memory, such as a disk storage. The memory 3002 may optionally be a memory device independent from the processor 3001.

It could be understood by those skilled in the art that the device structure shown in FIG. 3 does not constitute a definition of the apparatus, and the apparatus may include more or fewer components than illustrated, or combine certain components, or with diff rent component arrangements.

As shown in FIG. 3, a display panel control program can be included in the memory 3002 which is a readable storage medium.

In the apparatus shown in FIG. 3, the processor 3001 can be configured to call the display panel control program stored in the memory 3002 and execute the steps of the following described display panel control method.

In addition, the embodiment of the disclosure also provides a readable storage medium. In particular a display panel control program is stored in the readable storage medium, and the display panel control program is executed by the processor 3001 to perform the operation of related steps of the display panel control method in the following embodiments.

Figure 4:
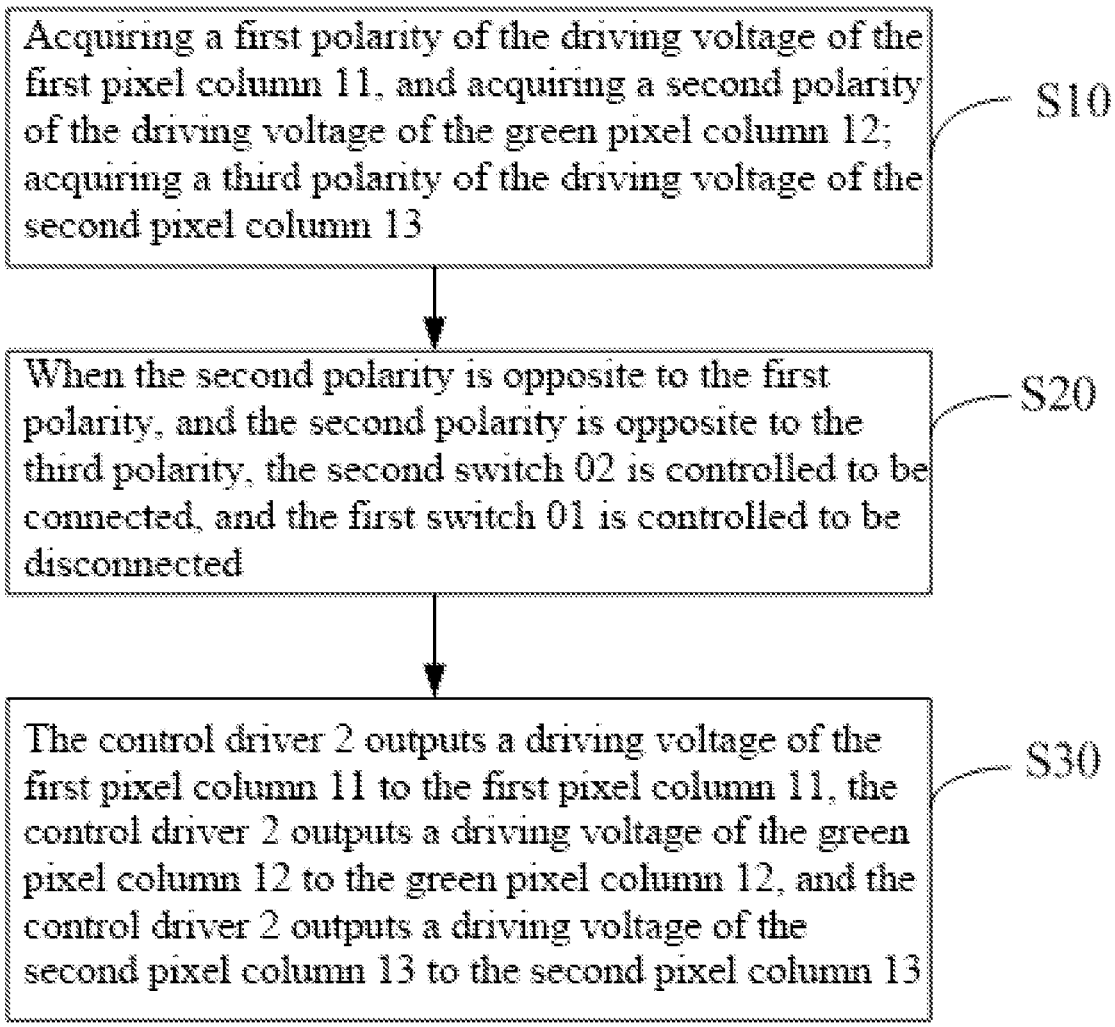
FIG. 4 is a flow diagram of a display panel control method according to an embodiment of the present disclosure.

Referring to FIG. 4, based on the display panel, the embodiment of the disclosure provides a display panel control method. The display panel control method includes the following steps:

Step S10, acquiring a first polarity of the drive voltage of the first pixel column 11, and acquiring a second polarity of the drive voltage of the green pixel column 12; and acquiring a third polarity of the drive voltage of the second pixel column 13.

The drive voltage of the first pixel column 11 is a drive voltage value with a polarity generated by the driver 2 according to the gray scale data corresponding to each first sub-pixel 111 in the first pixel column 11; the drive voltage of the green pixel column 12 is a drive voltage value with a polarity generated by the driver 2 according to the gray scale data corresponding to each green sub-pixel 121 in the first pixel column 11; and the drive voltage of the second pixel column 13 is a drive voltage value with a polarity generated by the driver 2 according to the gray scale data corresponding to each second sub-pixel 131 in the second pixel column 13.

The first polarity, the second polarity, and the third polarity each specifically includes a positive polarity or a negative polarity. The first polarity, the second polarity and the third polarity can be obtained after setting parameters of the driver 2 are acquired, or can be obtained through capturing output voltages of the driver 2 corresponding to the first pixel column 11, the green pixel column 12 and the second pixel column 13 and implementing a polarity testing or the like.

Step S20, in determining that the second polarity is opposite to the first polarity and the third polarity, controlling the second switch 02 to be connected and the first switch 01 to be disconnected.

When the green pixel column 12, the first pixel column 11, and the second pixel column 13 are driven by the drive voltages with opposite polarities, it indicates that the display panel is driven in the column inversion driving mode. For example, when the second polarity is negative, the first polarity and the third polarity is positive, at this time, the enable signal can be sent to the first switch 01 and the second switch 02, the first switch 01 is controlled to be disconnected, and the second switch 02 is controlled to be connected, so that the step-down unit 03 connected in series with each second switch 02 is connected in series with the corresponding green sub-pixel 121.

Step S30, controlling the control driver 2 to output a drive voltage of the first pixel column 11 to the first pixel column 11, a drive voltage of the green pixel column 12 to the green pixel column 12, and a drive voltage of the second pixel column 13 to the second pixel column 13.

The control driver 2 outputs a corresponding voltage value to the first sub-pixel 111, the green sub-pixel 121 and the second sub-pixel 131 respectively according to the drive voltage corresponding to each sub-pixel in the first pixel column 11, the green pixel column 12 and the second pixel column 13. Since each of the green sub-pixels 121 is connected with a step-down unit 03 in series, the voltage output by the driver 2 to the green sub-pixel 121 can be divided by the step-down unit 03, so that the drive voltage received by the green sub-pixel 121 is reduced. The drive voltage received by the first sub-pixel 111 and the drive voltage received by the second sub-pixel 131 are the same as the voltage value output by the driver 2.

In the embodiment, when the display array 1 is driven in the column inversion mode, the corresponding step-down unit 03 of each of the green sub-pixels 121 is connected into a channel of transmitting drive voltage, and the corresponding drive voltages are output to the first pixel column 11 and the green pixel column 12 and the second pixel column 13 respectively. The drive voltage received by the first sub-pixel 111 and the drive voltage received by the second sub-pixel 131 are the same as the voltage value output by the driver 2. Since each green sub-pixel 121 is connected in series with a step-down unit 03, the voltage output by the driver 2 to the green sub-pixel 121 can be divided by the step-down unit 03, so that the drive voltage received by the green sub-pixel 121 is reduced. The reduction of the drive voltage received by the green sub-pixel 121 can counteract the polarity coupling effect of the first pixel column 11 and the second pixel column 13 to the common voltage, and the green sub-pixel 121 is prevented from generating a green phenomenon when the pixel voltage corresponding to the green sub-pixel 121 is larger, so that the display effect of the display screen is improved.

Furthermore, based on the embodiment shown in FIG. 4, the step-down unit includes a resistor. Before the step of in determining that the second polarity is opposite to the first polarity and the third polarity, controlling the second switch 02 to be connected and the first switch 01 to be disconnected, the method further includes: obtaining image gray scale of the current display image frame; in determining that the image gray scale is not more than a preset value, executing the step of controlling the second switch 02 to be connected and the first switch 01 to be disconnected.

The image gray scale of the current display image frame is calculated according to a pixel gray scale corresponding to each of the sub-pixels in the display image frame, and the image gray scale represents the overall brightness of the current display image frame.

When the second polarity is opposite to the first polarity and the third polarity, the image gray scale of the current display image frame is obtained. When the image gray scale is not more than a preset value, indicating that the current display image frame is a low-gray-scale image, the second switch 02 can be controlled to be connected at the moment, and the first switch 01 is controlled to be disconnected.

In the embodiment, due to the fact that in a high-gray-scale image, the overall brightness of the display screen is large, and the green pixel column 12 is not easily perceptible to the naked eye even if the brightness is too bright. In a low-gray-scale image, the overall brightness of the display image is low, the polarity coupling causes the common voltage offset to cause the green pixel column 12 to be highlighted in the low-gray-order image and especially obvious, and the human eye is easier to perceive the green color in the low-gray-scale image which is reversely driven by the display column. Therefore, by means of the above mode, it is beneficial to ensure that the green phenomenon does not occur when a low-gray-order image is displayed, and the picture display quality of the display panel is improved.

Furthermore, based on the above embodiments, the display panel control method further includes:

in determining that the second polarity is the same as the first polarity and the third polarity, or in determining that the image gray scale is greater than the preset value, controlling the first switch 01 to be closed and the second switch 02 to be disconnected.

In the present embodiment, since when the second polarity is the same as the first polarity and the third polarity, drive voltages with polarity of the green pixel column 12, the first pixel column 11 and the second pixel column 13 pull the common voltage. The influence of the polarity coupling effect on the common voltage on each of the pixel columns is the same, so that the picture does not generate a green phenomenon. At this time, there is no need to reduce the drive voltage corresponding to each of the green sub-pixels 121 using the voltage dividing effect of the step-down unit 03. The first switch 01 is controlled to be connected and the second switch 02 is disconnected, so that the drive voltage received by each of the green sub-pixels 121 is the same as the voltage value output by the driver 2, so that the display quality of the display screen is ensured.

Figure 5:
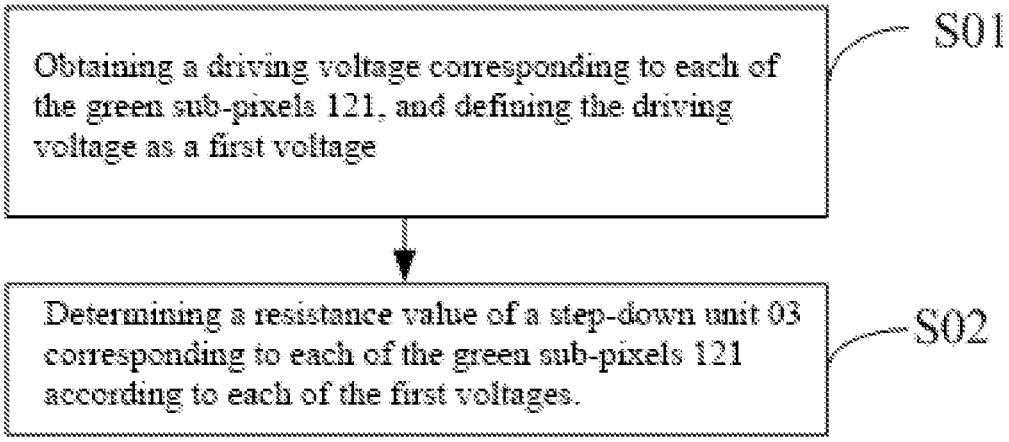
FIG. 5 is a flow diagram of a display panel control method according to another embodiment of the present disclosure.

Further, referring to FIG. 5, the step-down unit 03 may specifically be a resistor. Before the step of in determining that the second polarity is opposite to the first polarity and the third polarity, and in determining that the image gray scale is not more than the preset value, controlling the second switch 02 to be connected and the first switch 01 to be disconnected, the method further includes:

Step S01, obtaining the drive voltage corresponding to each of the green sub-pixels 121, and defining the drive voltage as a first voltage.

each of the green sub-pixels 121 has a drive voltage according to the gray scale required to be displayed by the green sub-pixel 121.

Step S02, determining a resistance value of the step-down unit 03 corresponding to each of the green sub-pixels 121 according to each first voltage.

In particular, the resistance value of the step-down unit 03 corresponding to the green sub-pixel 121 is the resistance value of the step-down unit 03 connected in the data line between the driver 2 and the green sub-pixel 121. Different first voltages can correspond to different resistance values of the step-down units 03. Specifically, there may be different voltage ranges corresponding to different resistance values of the step-down units 03. A voltage range that a first voltage falls in is determined, the resistance value of the step-down unit 03 is determined according to the voltage range that the corresponding first voltage falls in.

Specifically, the first voltage is larger, the influence of the polarity coupling effect of the common voltage to the green sub-pixel is smaller, thereby the resistance value of the corresponding step-down unit 03 can be smaller. On the contrary, the first voltage is smaller, the influence of the polarity coupling effect of the common voltage to the green sub-pixel is greater, thereby the resistance value of the corresponding step-down unit 03 can be larger.

In this embodiment, due to the polarity of the first voltage itself, a polarity coupling effect is also generated on the common voltage, the larger the first voltage is, the more the offset effect of the polarity coupling generated by the first pixel column 11 and the second pixel column 13 to the common voltage is, so that the smaller the pixel voltage of the green sub-pixel 121 in the green pixel column 12 is affected by the common voltage polarity coupling offset. Therefore, the resistance value of the step-down unit 03 connected in series with the green sub-pixel 121 is determined according to the first voltage, so that a voltage dividing value of the step-down unit 03 is adjusted, the drive voltage received by each of the green sub-pixels 121 can be adjusted more accurately, and it is beneficial to avoid the green color of the picture and ensure the display quality of the display screen.

Further, based on the embodiment of FIG. 5, the drive voltage corresponding to the first sub-pixel 111 adjacent to the green sub-pixel 121 is defined as a second voltage, and the drive voltage corresponding to the second sub-pixel 131 adjacent to the green sub-pixel 121 is defined as a third voltage. The step of determining a resistance value of the step-down unit 03 corresponding to each of the green sub-pixels 121 according to each first voltage includes:

Step S020, determining the resistance value of the step-down unit 03 corresponding to each of the green sub-pixels 121 according to the first voltage and the corresponding second voltage and the corresponding third voltage.

Figure 6:
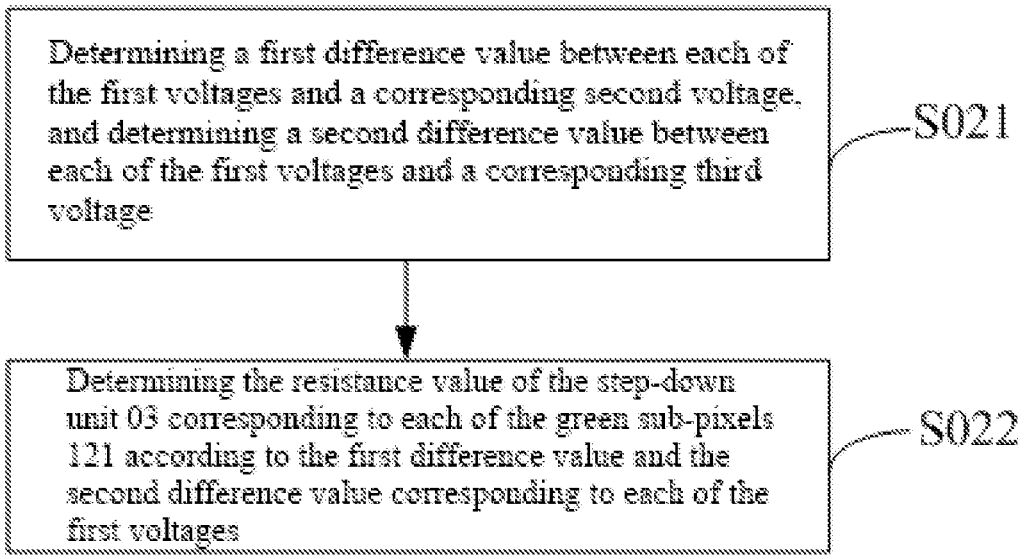
FIG. 6 is a flow diagram of a display panel control method according to still another embodiment of the present disclosure.

In particular, referring to FIG. 6, step S020 includes the following steps:

Step S021, determining a first difference value between each of the first voltages and a corresponding second voltage, and determining a second difference value between each of the first voltages and a corresponding third voltage.

Step S022, determining the resistance value of the step-down unit 03 corresponding to each of the green sub-pixels 121 according to the first difference value and the second difference value corresponding to each of the first voltages.

In particular, the step-down unit 03 can be a resistor, and a corresponding relationship between the first difference value, the second difference value and the resistance value of the corresponding step-down unit 03 can be established, and the corresponding relationship can be particularly a formula, a table or the like. By establishing a preset formula, the corresponding resistance value of each of the green sub-pixels 121 can be calculated according to the first difference value and the second difference value. Or, first difference value is used as a row in the resistance searching table, and second difference value is used as a column in the resistance value searching table, preset resistance values corresponding to first difference values and second difference values are used as the values in the table. After the first difference value and the second difference value are determined, a corresponding resistance value obtained from the searching table can be used as the resistance value of the step-down unit 03 corresponding to a corresponding green sub-pixel 121.

In addition, a first preset eight can also be set according to the first difference value, a second preset weight is correspondingly set for the second difference value, and a comprehensive difference is obtained through a weighted average calculation according to the first difference value and the corresponding first preset weight and the second difference value and the corresponding second preset weight.

In addition to Step S021 and Step S022, a corresponding relationship between the first voltage, the second voltage and the third voltage and the resistance value of the corresponding step-down unit 03 can be directly established. For example, the resistance value R=(XV1−YV2−ZV3)*M, in particular, V1 is the first voltage, V2 is the second voltage, V3 is the third voltage, X, Y, Z and M are preset coefficients. The resistance value of the step-down unit 03 corresponding to each of the green sub-pixels 121 is directly calculated through the formula.

In the present embodiment, the green sub-pixel 121 seen by the human eye is affected by the brightness of the sub-pixels adjacent to the green sub-pixel 121. In order to make the adjustment of the drive voltage corresponding to each of the green sub-pixels 121 more accurate, the resistance value of the step-down unit 03 corresponding to each of the green sub-pixels 121 is determined by combining the first voltage, the second voltage and the third voltage, the voltage on each step-down unit 03 can be accurately adjusted, and the display quality of the display screen can be further improved and at the same time the picture to be green is avoided.

In addition, the embodiment of the disclosure further provides a display panel control apparatus including:

a collector configured to acquire a first polarity of a drive voltage of a first pixel column 11, a second polarity of a drive voltage of a green pixel column 12; and a third polarity of a drive voltage of a second pixel column 13;

an actuator configured to control a second switch 02 to be connected and a first switch 01 to be disconnected in determining that the second polarity is opposite to the first polarity and the third polarity;

a controller configured to control a driver 2 to output the drive voltage of the first pixel column 11 to the first pixel column 11, the drive voltage of the green pixel column 12 to the green pixel column 12, and the drive voltage of the second pixel column 13 to the second pixel column 13.

Further, the display panel control apparatus also includes a gray scale detector configured to acquire an image gray scale of a current display image frame in determining that the second polarity is opposite to the first polarity and the third polarity, and send an instruction to the actuator in determining that the image gray scale is not more than a preset value. The actuator is configured to control the second switch 02 to be connected and the first switch 01 to be disconnected upon receiving the instruction.

Further, the display panel control apparatus also includes a step-down unit regulator configured to acquire a drive voltage corresponding to each of green sub-pixels 121, define the drive voltage as a first voltage and determining a resistance value of a step-down unit 03 corresponding to each of the green sub-pixels 121 according to each first voltage before the step of controlling the second switch 02 to be connected and the first switch 01 to be disconnected in determining that the second polarity is opposite to the first polarity and the third polarity and the image gray scale is not more than a preset value.

A drive voltage corresponding to a first sub-pixel 111 adjacent to the green sub-pixel 121 is defined as a second voltage, and a drive voltage corresponding to second sub-pixel 131 adjacent to the green sub-pixel 121 is defined as a third voltage, and the step-down unit regulator is particularly configured to determine a resistance value of the step-down unit 03 corresponding to each green sub-pixel 121 according to the first voltage and the corresponding second voltage and the corresponding third voltage.

Further, the step-down unit regulator is specifically configured to determine a first difference between the first voltage and the corresponding second voltage, and determine a second difference value between the first voltage and the corresponding third voltage; and determine the resistance value of the step-down unit 03 corresponding to each of the green sub-pixels 121 according to the first difference value and the second difference value corresponding to each of the first voltages.

In addition, the actuator is further configured to control the first switch 01 to be connected and the second switch 02 to be disconnected in determining that the second polarity is the same as the first polarity and the third polarity or the image gray scale is greater than the preset value.

In particular, the collector, the controller, the gray scale detector and the like can be integrated in the TCON (Timing Controller) of the display panel, and the step-down unit regulator can be embedded in a source driver of the display panel. The TCON can send an enable signal to the source driver, and the step-down unit regulator in the source driver can control the disconnection or connection of the first switch 01 and the second switch 02 according to the enable signal after receiving the enable signal.

It should be noted that, herein, the terms "include", "comprise" or any other variation thereof, are intended to cover a non-exclusive inclusion, such that a process, method, article, or system that includes a series of elements not only includes those elements but also includes other elements not expressly listed, or that is an element inherent to such process, method, article, or system.

The serial numbers of the embodiments of the present disclosure are described merely for the purpose of description and do not represent the disadvantages of the embodiments.

Through the description of the embodiments above, it will be clear to those skilled in the art that the above-described embodiments can be realized by means of a software-plus-necessary general-purpose hardware platform, although, of course, the former can be implemented in hardware, but in many cases the former is a better embodiment. Based on such an understanding, the technical solutions of the present disclosure may be embodied in the form of a software product that is embodied in a software product that is stored in a storage medium (e.g., ROM, RAM, magnetic disk, optical disk) as described above, including several instructions for causing a terminal device (which may be a cell phone, a computer, a server, an air conditioner, or a network device, etc.) to perform the method of various embodiments of the present disclosure.

The disclosure is merely an alternative embodiment of the present disclosure, and is not intended to limit the scope of the disclosure. Any equivalent structure or equivalent process transformation made by using the description and the drawings of the present disclosure, or applications in other related technical fields either directly or indirectly, and are all included in the patent protection scope of the present disclosure.

The invention claimed is:

1. A display panel, comprising:

a display array comprising a plurality of pixel groups, each of the pixel groups comprising a first pixel column, a green pixel column and a second pixel column sequentially, the green pixel column comprising a plurality of green sub-pixels, the first pixel column comprising a plurality of first sub-pixels, and the second pixel column comprising a plurality of second sub-pixels; and a driver connected to each of the green sub-pixels, each of the first sub-pixels, each of the second sub-pixels through a data line, the data line through which each of the green sub-pixels is connected to the driver comprising a first branch and a second branch connected in series with the first branch, the first branch being configured with a first switch, the second branch being configured with a second switch and a step-down unit connected in series with the second switch; the second switch being turned on and the first switch being turned off in response to that a polarity of a drive voltage of the green pixel column is opposite to a polarity of a drive voltage of the first pixel column and a polarity of a drive voltage of the second pixel column.

2. The display panel of claim 1, wherein, each of the green sub-pixels, each of the first sub-pixels and each of the second sub-pixels respectively comprise a thin film transistor, and the driver connected to a source of the thin film transistor through the data line.

3. The display panel of claim 1, wherein the first pixel column is a red pixel column, and the second pixel column is a blue pixel column.

4. The display panel of claim 1, wherein the first switch and the second switch are metal oxide semiconductor transistors.

5. The display panel of claim 4, wherein the first switch is a P-type metal oxide semiconductor transistor, and the second switch is an N-type metal oxide semiconductor transistor.

6. The display panel of claim 1, wherein the polarity of the drive voltage of the first pixel column of one of any two adjacent pixel groups and the polarity of the drive voltage of the second pixel column of the one of the two adjacent pixel groups are both positive polarities, and the polarity of the drive voltage of the green pixel column of the one of the two adjacent pixel groups is a negative polarity; and the polarity of the drive voltage of the first pixel column of the other of the two adjacent pixel groups and the polarity of the drive voltage of the second pixel column of the other of the two adjacent pixel groups are both negative polarities, and the polarity of the drive voltage of the green pixel column of the other of the two adjacent pixel groups is a positive polarity.

7. The display panel of claim 1, wherein the step-down unit is a variable resistor with adjustable resistance.

8. The display panel of claim 1, wherein the display panel further comprises a display panel control device, the display panel control device comprises:

a collector configured for obtaining the first polarity of the drive voltage of the first pixel column, the second polarity of the drive voltage of the green sub-pixel column, and the third polarity of the drive voltage of the second pixel column;

an actuator configured for controlling the second switch to be connected and the first switch to be disconnected when the second polarity is opposite to the first polarity and the third polarity; and a controller configured for controlling a driver to output the drive voltage of the first pixel column to the first pixel column, controlling the driver to output the drive voltage of the green pixel column to the green pixel column, and controlling the driver to output the drive voltage of the second pixel column to the second pixel column.

9. A display panel control method applied to a display panel, wherein the display panel comprises:

a display array, comprising a plurality of pixel groups, the pixel group comprising a first pixel column, a green pixel column and a second pixel column sequentially, the green pixel column comprising a plurality of green sub-pixels, the first pixel column comprising a plurality of first sub-pixels, and the second pixel column comprising a plurality of second sub-pixels; and a driver, connected to each of the green sub-pixels, each of the first sub-pixels, and each of the second sub-pixels through a data line, the data line through which each of the green sub-pixels is connected to the driver comprising a first branch and a second branch connected in series with the first branch, the first branch is configured with a first switch, and the second branch is configured with a second switch and a step-down unit connected in series with the second switch;

the display panel control method comprises the following steps:

obtaining a first polarity of a drive voltage of the first pixel column, obtaining a second polarity of a drive voltage of the green pixel column, and obtaining a third polarity of a drive voltage of the second pixel column;

in response to that the second polarity is opposite to the first polarity and the third polarity, controlling the second switch to be connected and the first switch to be disconnected; and controlling the driver to output the drive voltage of the first pixel column to the first pixel column, controlling the driver to output the drive voltage of the green pixel column to the green pixel column, and controlling the driver to output the drive voltage of the second pixel column to the second pixel column.

10. The display panel control method of claim 9, wherein the step of obtaining a first polarity of a drive voltage of the first pixel column, obtaining a second polarity of a drive voltage of the green pixel column, obtaining a third polarity of a drive voltage of the second pixel column comprises:

performing polarity testing on an output voltage of the driver corresponding to the first pixel column, the green pixel column and the second pixel column for obtaining the first polarity, the second polarity and the third polarity.

11. The display panel control method of claim 9, wherein, prior to the step of in response to the second polarity is opposite to the first polarity and the third polarity, controlling the second switch to be connected and the first switch to be disconnected, the method further comprises:

obtaining an image gray scale of a current display image frame; and in response to that the image gray scale is not more than a preset value, executing the step of controlling the second switch to be connected and the first switch to be disconnected.

12. The display panel control method of claim 11, wherein the step of obtaining an image gray scale of the current display image frame comprises:

obtaining a pixel gray scale corresponding to each of sub-pixels in the current display image frame; and calculating the image gray scale according to the pixel gray scale.

13. The display panel control method of claim 11, wherein, the step-down unit comprises a resistor, prior to the step of in response to that the second polarity is opposite to the first polarity and the third polarity, and the image gray scale is not less than a preset value, controlling the second switch to be connected and the first switch to be disconnected, the method further comprises:

obtaining a corresponding drive voltage of each of the green sub-pixels, and defining the corresponding drive voltage as a first voltage; and based on the first voltage, determining a resistance of the step-down unit corresponding to each of the green sub-pixels.

14. The display panel control method of claim 13, wherein, a corresponding drive voltage of the first sub-pixel adjacent to the green sub-pixel is defined as a second voltage, a corresponding voltage of the second sub-pixel adjacent to the green sub-pixel is defined as a third voltage, the step of based on the first voltage, determining a resistance of the step-down unit corresponding to each of the green sub-pixels comprises:

determining the resistance of the step-down unit corresponding to each of the green sub-pixels based on the first voltage, the second voltage and the third voltage corresponding to the first voltage.

15. The display panel control method of claim 14, wherein, the step of determining the resistance of the step-down unit corresponding to each of the green sub-pixels based on the first voltage, the second voltage and the third voltage corresponding to the first voltage comprises:

determining a first difference value between the first voltage and the second voltage corresponding to the first voltage, determining a second difference value between the first voltage and the third voltage corresponding to the first voltage; and determining the resistance of the step-down unit corresponding to each of the green sub-pixels based on the first difference value and the second difference value corresponding to the first voltage.

16. The display panel control method of claim 15, wherein the step of determining the resistance of the step-down unit corresponding to each of the green sub-pixels according to the first difference value and the second difference value corresponding to the first voltage comprises:

inquiring a preset resistance searching table, and taking a preset resistance obtained according to the first difference value and the second difference value corresponding to the first voltage as the resistance of the step-down unit corresponding to the green sub-pixel.

17. The display panel control method of claim 11, further comprising:

in response to that the second polarity is the same with the first polarity and the third polarity, or, in response to that the image gray scale is larger than the preset value, controlling the first switch to be connected and the second switch to be disconnected.

18. The display panel control method of claim 9, wherein prior to the step of controlling the driver to output the drive voltage of the first pixel column to the first pixel column, controlling the driver to output the drive voltage of the green pixel column to the green pixel column, and controlling the driver to output the drive voltage of the second pixel column to the second pixel column, the method further comprises:

in response to that the second polarity is the same as the first polarity and the third polarity, controlling the first switch to be connected and the second switch to be disconnected.

19. A display panel control apparatus, comprising a storage, a processor and a display panel control program stored in the storage and executable by the processor, wherein the display panel control method of claim 9 is performed when the display panel control program is executed by the processor.

* * * * *